United States Patent [19]

Arad

[11] 4,014,543

[45] Mar. 29, 1977

[54] AIR ACTION GAME

[75] Inventor: Avi Arad, New York, N.Y.

[73] Assignee: Innovisions Enterprises, Inc., New York, N.Y.

[22] Filed: Dec. 9, 1975

[21] Appl. No.: 638,986

[52] U.S. Cl. ..... 273/85 H; 273/94 R; 273/129 F

[51] Int. Cl.[2] ..... A63F 7/06

[58] Field of Search ..... 273/85, 86 D, 119 B, 273/125 R, 95 C, 129 F, 94, 126 A; 46/44

[56] References Cited

UNITED STATES PATENTS

| | | | |
|---|---|---|---|
| 2,716,028 | 8/1955 | Yaeger | 273/85 B |
| 3,771,789 | 11/1973 | Kammerl | 273/85 H |
| 3,854,727 | 12/1974 | Abraham | 273/125 R |

FOREIGN PATENTS OR APPLICATIONS

| | | | |
|---|---|---|---|
| A60,324 | 4/1954 | France | 273/85 A |
| 2,254,072 | 5/1974 | Germany | 273/85 H |
| 306,085 | 6/1955 | Switzerland | 273/119 B |
| 311,257 | 1/1956 | Switzerland | 273/85 F |
| 22,768 | 12/1894 | United Kingdom | 273/85 H |

*Primary Examiner*—Anton O. Oechsle
*Attorney, Agent, or Firm*—Kirschstein, Kirschstein, Ottinger & Frank

[57] ABSTRACT

An indoor game comparable in objective to the sport of soccer. A ball or other playing piece is propelled by air streams discharged from opposed nozzles horizontally from above each goal, the latter being in the form of a recess on a game table top. The nozzles are swiveled so that each air stream may be played horizontally across the entire top surface of the table. A plurality of freely rotatable vertical baffles is disposed on the upper surface of the table top to provide air-spinnable ball obstacles, comparable to real life soccer players, that, on occasion, trap the playing piece and thereafter fling the piece across the table top in a semi-predictable, semi-random course.

11 Claims, 8 Drawing Figures

3
24
20
30
16
25
22
28
38
R
44
48
10
52
26
18
32
50
5
36
40
25
34
42
46
12
14

28
16
24
25
30
44
22
6
R
10
44
62
20
54
60
58
54
56

AIR ACTION GAME

BACKGROUND OF THE INVENTION

1. Field of the Invention

The invention relates to the class of indoors games in which players competitively attempt to maneuver a ball or other playing piece into their opponent's goal, or other recess in a table or the like, while protecting their own goal.

2. Description of the Prior Art

Numerous indoors games have been devised which are played with one or a plurality of balls or other playing pieces, and in which the objective of the game is to maneuver object balls on a table into a hole or pocket. A classic example is the game of pool. In this game, a player uses a cue stick to propel a cue ball against one or a plurality of object balls, so as to cause selected object balls to drop into specific peripheral pockets on the table.

The sport of soccer has been popular for many years in Europe and South America. This outdoors sport is played on a field having two opposed goals at opposite ends of the field. The goals consist of enclosures with open mouths facing the field. The objective of a team of players is to kick or otherwise propel the ball, which is about the size and configuration of a basketball, into the goal of the opposing team. The game is played without the use of hands except for the single player stationed at each goal, known as the goalie, who may use any part of his body to block and prevent the entry of the ball into the goal and thus to prevent the opposing team from making a score.

A popular indoors game played with a light weight, low density hollow ball is Ping-Pong, which is played on a horizontal table having a central transverse vertical net. Each of the two opposed players has a paddle to propel the Ping-Pong ball over the net. Points are made by hitting the ball over the net and onto the opposite side of the table in such a manner that the opponent cannot return the ball across the net into the opposite playing area after a single bounce.

A popular indoors or outdoors sport played with a plurality of players i.e., a team, on each side, is hockey, typically ice or roller hockey, played by players having sticks provided with blades to propel a disc-shaped puck across the surface of the court and into the opponent's goal. The players move about on the court or field using ice skates or roller skates, as the case may be.

SUMMARY OF THE INVENTION

1. Purposes of the Invention

It is an object of the present invention to provide a novel indoors game which offers the players amusement and challenge.

Another object is to provide an indoors game comparable in objective and arrangement to the outdoors game of soccer.

A further object is to provide an indoors game which is fast in action and requires a combination of skill and chance to win.

An additional object is to provide an exciting and amusing indoors game in which a low density projectile is propelled about on a table top having freely rotatable vertical baffles disposed thereon, the projectile being propelled about by at least two horizontal streams of air which are angularly directed across the table top against the moving projectile from nozzles controlled by the players, each player controlling the angular direction of a single nozzle.

Still another object is to provide an improved indoors game in which the objective is to maneuver an air stream so as to deposit a low density ball or other projectile disposed on a table or the like into a pocket or other recess disposed on the opponent's side of the table.

These and other objects and advantages of the present invention will become evident from the description which follows.

2. Brief Description of the Invention

In the present invention, an indoors air action game is provided which may be played by two or more players. The objective of the game is comparable to that of the outdoors sport of soccer, i.e., to propel a ball, disc or the like projectile into an opponent's goal. In the specific game described herein, the ball is propelled by air streams about and across a flat horizontal table top, each air stream being angularly directed by one of the players. A typical air stream velocity is on the order of 10 feet per second. The ball is light in weight and low in density, comparable to a Ping-Pong ball or a ball composed of foamed polyurethane or polyvinyl chloride plastic or the like. Typically the ball is of featherweight consistency, weighing e.g., 2 grams and having a diameter of about 1 inch. A foamed rubber ball may also be used in the game, but its action is somewhat sluggish. The table top is provided with walls on its outer sides or edges, which walls extend above the upper surface of the typically rectangular table so that the ball is not blown off the table top by the air streams. The air streams emanate from swiveled air stream guns, i.e., nozzles, or other means to project air streams horizontally across the upper surface of the table top from adjacent and above individual rear and side guarded pockets or recesses, which constitute goals. Each player is stationed at a single pocket or recess and controls a single swiveled air stream gun. To complete the game in its broadest and most general embodiment, a plurality of groups of freely rotatable vertical baffles are disposed on the upper surface of the table top. The air streams can rotate the baffles about different vertical axes for the different groups, in addition to propelling the ball about on the table top. The objective of the game is for a player to so maneuver his air stream gun as to play his air stream about on the upper surface of the table to accomplish the movement of the ball into his opponent's recess or pocket, i.e., the goal, and thereby make a score. At the same time the player attempts to defeat his opponent's efforts to deposit the ball in the player's goal.

The preferable number of players is two, and, therefore, the preferable number of opposed recesses and associated swiveled means to project air substantially horizontally across the upper surface of the table top from above a recess is also two. The swiveled means to project an air stream from above a recess typically entails an air blower mounted below the table top, an electric motor or the like to rotate the blades or vanes of the air blower, a vertically oriented circular collar extending upwards through the table top at the rear of each recess, conduits to conduct an air stream to each collar from the blower, a transition tube extending upwards from the collar to a substantially horizontal air discharge nozzle above the recess, a mounting for the gun or collar that permits rotation of the gun about a vertical axis to provide swiveling action, and a lever to maneuver the nozzle in rotary fashion about said vertical axis. The extent of rotation of the nozzle will generally be over a semi-circular path, so that the horizontal air stream may be played into adjacent corners of the table top as well as directly forwards, at an angle, or angularly above the table top. The air discharge nozzle will preferably be non-circular so as to produce laminar rather than turbulent air flow. A preferred configuration for this tube is a trapezoidal cross-section with the long or wide side of the trapezoid downward adjacent to the table top, so as to propel most of the air stream directly across the table top immediately above the surface in a laminar flow. Other suitable configurations for the air discharge tube include a flat rectangular cross-section, with the longer axis parallel to the top surface of the table; and a flat horizontal base or bottom surmounted by a semi-circular top section. A foraminous enclosure is preferably provided at the sides and rear of each recess as a guard, to complete the analogy to the goal region of an outdoors soccer field.

The rotatable vertical baffles on the table top are preferably disposed thereon as a plurality of individual unit clusters having a cruciform horizontal cross-section, with each individual unit being pivoted at its central vertical axis on a vertical pivot or spindle which extends upwards from the table top. A flat representative small human figure in the form and dress of a soccer player is desirably mounted on each side of each baffle, and a three-dimensional figure resembling a goalie is set astride the front end of the horizontal air discharge tube to complete the soccer game effect and illusion.

The projectile, i.e., playing piece, may be composed of any of the materials mentioned supra and may be solid foamed material or may be hollow, such as Ping-Pong ball, however, the density or mass of the projectile contemplated in the present invention will be in most instances somewhat greater than that of the average Ping-Pong ball. It will be evident to those skilled in the art that the density, mass and/or dimension of the projectile will be correlated in each particular instance with the air stream velocity and/or volumetric flow rate, so that the projectile may be freely propelled about on the upper surface of the table without being lifted off the table. This correlation will of course be empirically determined for a particular game design, i.e., a smaller table, projectile and air flow rate or velocity for a child's game, and a larger table and projectile and greater air flow rate and velocity for the adult market. The projectile may be in any suitable shape or form, e.g., round like a ball, disc-shaped like a hockey puck, football-shaped, cubic, etc.

In most instances it will be preferable to provide curved corners where the side walls of the table meet, in order to prevent the projectile from lodging in a corner where it would cease to move thereby stopping the game action. In addition, the central portion of the side walls which do not have recesses and associated swiveled air stream guns will usually be provided with a baffle that is substantially triangular in plan, in the form of an isosceles triangle having its base at the side wall, which baffle will extend inwards onto the playing surface of the table top to prevent the projectile motion from ceasing due to equal opposing air stream endwise vectors and a net sidewise vector of the air streams in that area. This triangular baffle will have an apex which points towards the center of the table top, and the equal sides of the triangular baffle extending from the apex to the side walls will preferably be concave.

The invention accordingly consists in the features of construction, combination of elements and arrangements of parts which will be exemplified in the games hereinafter described and of which the scope of application will be indicated in the appended claims.

BRIEF DESCRIPTION OF THE DRAWINGS

In the accompanying drawings in which are shown various possible embodiments of the invention.

DETAILED DESCRIPTION OF THE PREFERRED EMBODIMENTS

Figure 1:
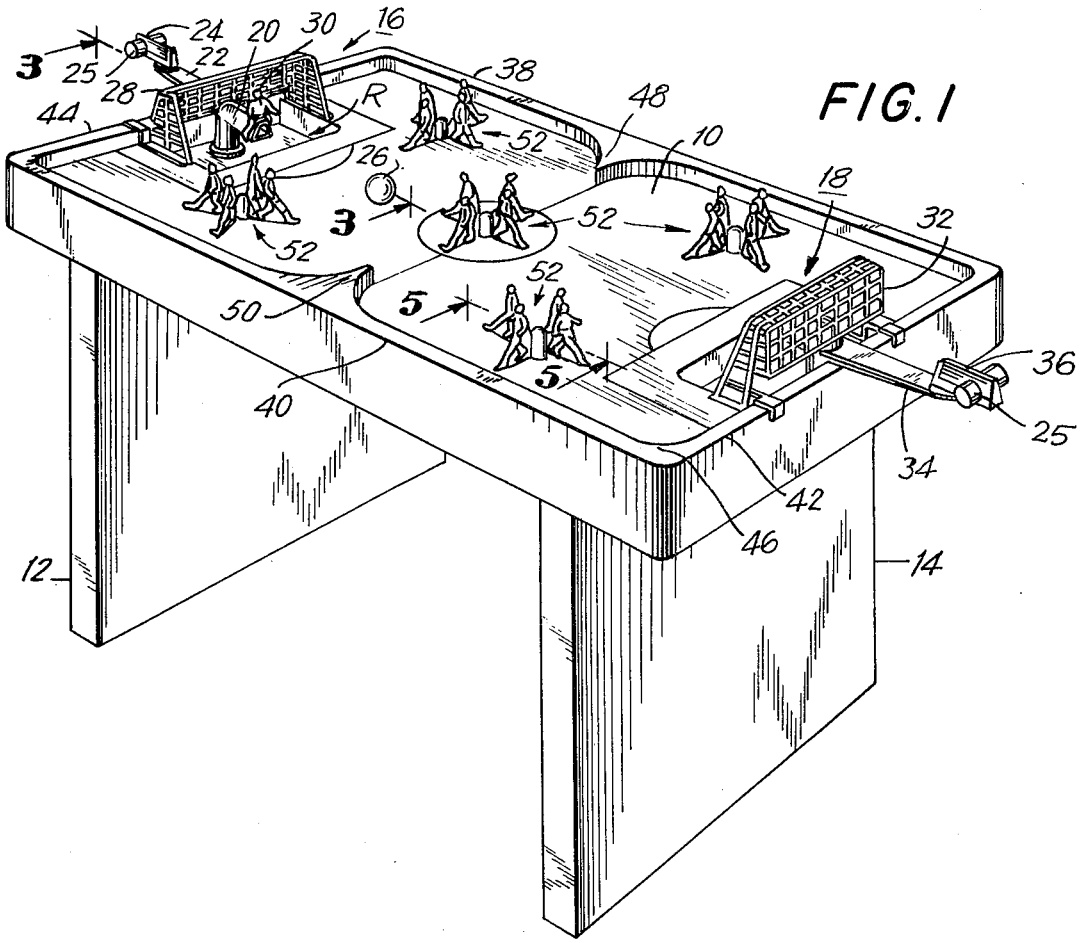
FIG. 1 is an overall perspective view of an air action game according to the present invention.

Referring now to FIG. 1, the air action game in this embodiment of the invention is a simulated soccer game. A generally rectangular flat horizontal table top 10 is supported adjacent to its narrow ends by opposed vertical rectangular support members 12 and 14. A goal area generally designated as 16 is provided centrally at one end of the table top 10 and an opposed goal area generally designated as 18 is provided at the opposite end of the table top above member 14. The goal area 16 and its appurtenances are identical in configuration to the opposed goal area 18 and its appurtenances.

The goal area 16 is characterized by the provision of a swiveled air stream gun 20, midway between the sides of the top 10, which is rotatable about a semi-circular field of play (see FIG. 4) by a horizontal lever 22 which extends rearwards from the gun 20 to a suitable handle 24 that is manipulated by the player stationed at the goal area 16. The player when the game is in service moves the lever laterally to rotate the gun 20 and thereby control the direction of discharge of an air stream from gun 20 against a projectile in the form of a ball 26 which is disposed on the table top 10. The goal area 16 has a foraminous enclosure 28, i.e., backstop, which extends upwards from the sides and back of a recess R and over the top of said recess. However, the enclosure 28 does not extend over the front of the recess. The recess has its open mouth flush with the upper surface of the table top 10. Thus, when the game is being played, the ball 26 may be propelled by the player stationed at the goal area 18 into the recess R at the goal area 16 and vice versa, and when the ball 26 falls down into the recess at the goal area 16, the player at the goal area 18 has scored a point. It is apparent that the player stationed at the goal area 16 can act to try to prevent this by suitable manipulation of his air gun 20. Thus, the game provides a simulation of the game of soccer, with a small figure 30 mounted on air gun 20 simulating the goalie who tries to prevent the ingress of the ball 26 into the recess at the goal area 16.

Appurtenances of the goal area 18 are also shown in FIG. 1, namely a foraminous back stop 32, a lever 34 and a handle 36.

The table top 10 is provided with walls 38, 40, 42 and 44 at its outer edges, which walls extend above the upper surface of the typically rectangular table top 10 to prevent the ball 16 from being blown off the table top by the air streams. Curved corners such as 46 preferably are provided where walls such as 40 and 42 meet, so as to prevent ball 26 from lodging in a rightangled corner which might stop the game action, since if corner 46 were right-angled, the air streams from gun 20 and the gun of recess 18 might merely force the ball 26 to remain in the corner. The radius of the corner 46 exceeds the radius of the ball for the same reason. In addition, an inward projection 48 on the wall 38 is preferably and generally provided in practice, together with an opposed projection 50 on the wall 40. The purpose of these projections 48 and 50 is similar to the reason for the provision of the curved corners such as 46, i.e., to prevent game action from stopping. In the case of the projections 48 and 50, these projections which may be characterized as being substantially triangular in the form of an isosceles triangle having its base at the side wall with an apex which points towards the center of table top 10, are provided at the middle or central portion of each side wall to prevent motion of ball 26 from ceasing due to passage into a region where the end-to-end vectors of the two opposed air streams are substantially equal and cancel out and the lateral vectors are additive, forcing the ball against the wall so that no motion can take place. The side walls of each projection 48 and 50 are desirably curved to provide a concave surface to further facilitate motion of ball 26, in a manner similar to the considerations relative to the curved corners 46.

The air action game of FIG. 1 is completed in its preferred embodiment by the provision of a plurality of spaced vertical baffles in the form of individual unit clusters 52, which simulate soccer players on a soccer field. A print of a soccer player is disposed on, and forms part of each individual flat vertical baffle. Each cluster 52 has a generally cruciform horizontal cross-section of which each arm constitutes a radially extending individual baffle. Each cluster is pivoted at its central vertical axis on a vertical spindle which extends upwards from the table top 10, as will appear infra, so that each cluster 52 can freely rotate when an air stream is directed against it during the course of the game, i.e., when the ball 26 is in proximity to a particular cluster 52. The bottom edges of individual baffles are spaced apart to permit entry of the ball between adjacent baffles. The ball 26 will of course strike individual baffles of a cluster 52 during the course of the game, and may in fact temporarily lodge in a corner of a cluster 52; however, since the clusters 52 freely rotate about a vertical axis, the play of the air guns soon causes the cluster to rotate and free the ball which is propelled by an individual baffle on which it rests so that the game progresses until a score is made. It is evident that the game provides fast action and a great challenge to the skill of the players in manipulating the air guns, both against the fast moving ball 26 and against a cluster 52 with which the ball may be temporarily associated.

Figure 2:
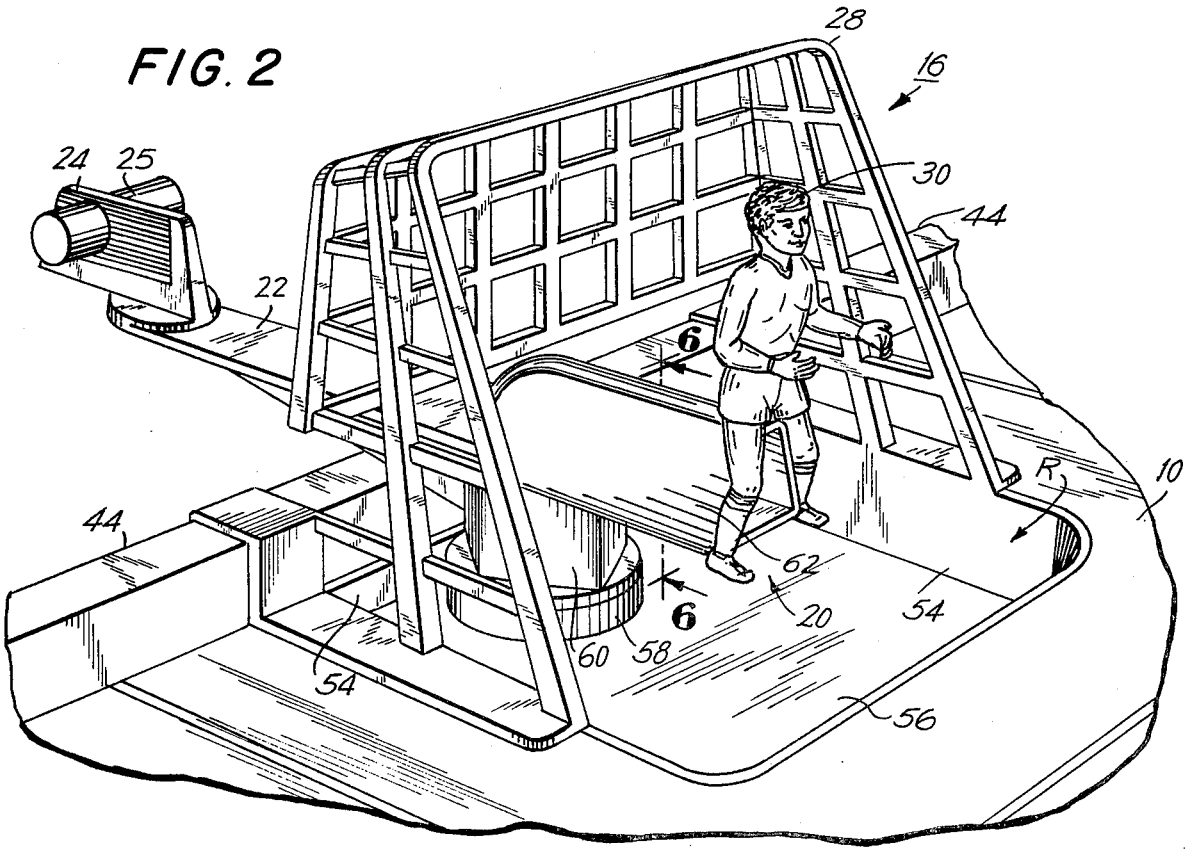
FIG. 2 is an enlarged fragmentary perspective view of a goal end of the game of FIG. 1.

Referring now to FIG. 2, the goal area 16 is shown in greater detail. The recess R is formed by vertical boundary walls such as 54 which extend downwards a short distance from the level of table top 10, and a horizontal bottom or floor 56 below the level of table top 10. The unitary air gun 20 is provided with a straddling figure 30 which is of the configuration of a goalie of a soccer team. The floor 56 is far enough below the bottom of the gun to accommodate the ball 26 without interference with the swiveling movement of the gun. As will appear infra, an air stream for the air gun 20 is generated below the table top 10 and is conducted up through a circular collar 58 on which the gun is mounted in such fashion as to enable the gun to oscillate approximately 180° about the vertical axis of collar 58 so that the air stream can be directed by the player over an arc embracing both adjacent corners 46. A transition tube 60 extends upwards from the collar 58 to a substantially horizontal air discharge nozzle 62. The nozzle 62 is of trapezoidal cross-section. By way of example, to achieve the aforesaid oscillatable mounting, an annular rib is formed near the upper end of the collar 58 to fit into an annular groove near the lower end of the tube 60. The back stop is formed with a horizontal slot extending along the near and the rear portions of the back stop to permit swinging movement of the lever 22 between extreme positions shown by dash and double dot lines in FIG. 4 which are defined by abutment of the nozzle against opposite ends of said slot.

Figure 6:
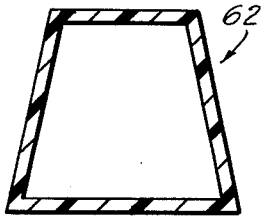
FIG. 6 is an enlarged sectional view of a trapezoidal air discharge tube taken substantially along the line 6—6 of FIG. 2.

The polygonal cross-section of the nozzle tends to inhibit swirling motion of the air stream as it leaves the nozzle and as it flows at high speed across the table top. Best results have been observed with a trapezoidal configuration with the base lowest (see FIG. 6). The air stream, due to its speed and to the laminar flow thereof resulting from the substantial suppression of swirl, will propel the ball, when impinging thereon, at a high speed and does not exert an upward force sufficent to lift the ball off the table top. Hence the players obtain a fast and exciting action.

Figure 3:
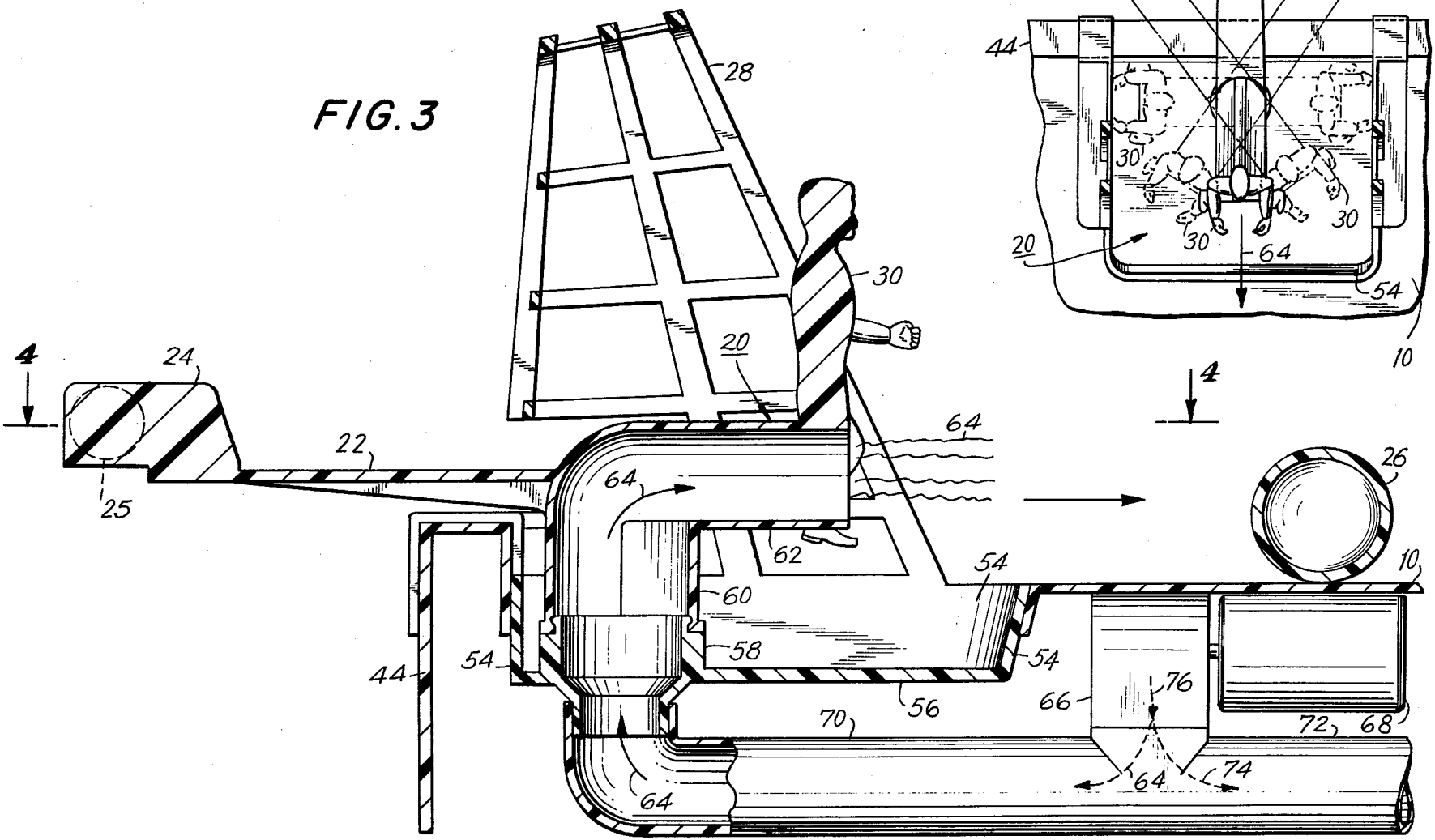
FIG. 3 is an enlarged fragmentary sectional view taken substantially along the line 3—3 of FIG. 1.

FIG. 3 shows the air stream 64 emanating from the air gun 20. The stream is generated by a fan or blower 66 which is rotated by an electric motor 68. The air stream 64 flows from the blower 66 through a manifold branch 70 to the collar 58 and manifold branch 72 conducts an air stream 74, shown in phantom outline, to the collar associated with the goal area 18. The air streams 64 and 74 are substantially equal portions of the total air stream 76 generated by the fan or blower 66. FIG. 3 also shows a further preferred embodiment of the invention, in which the lever 22 or most preferably the handle 24 is provided with a transverse horizontal extension 25 to facilitate grasping of the lever 22 by a player for ease in manipulation of the air stream gun 20.

Figure 4:
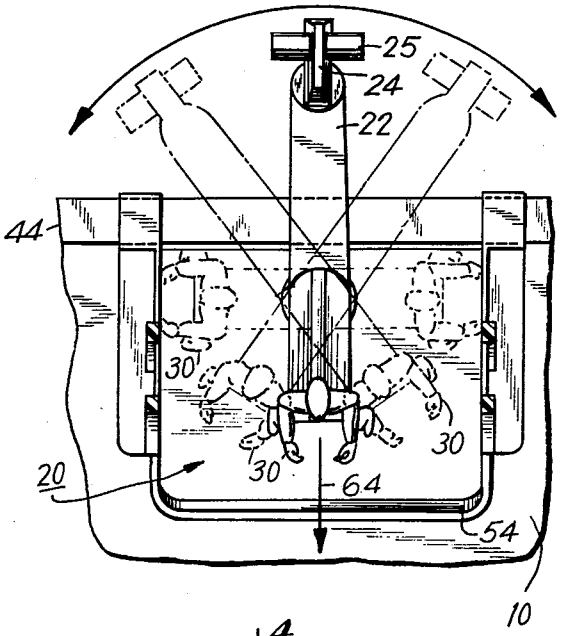
FIG. 4 is a reduced fragmentary top view of the game taken substantially along the line 4—4 of FIG. 3.

Referring now to FIG. 4, the swivel action of the air gun 20 is apparent, with the direct forwards position shown in full outline and angular and transverse positions shown in phantom outline.

Figure 5:
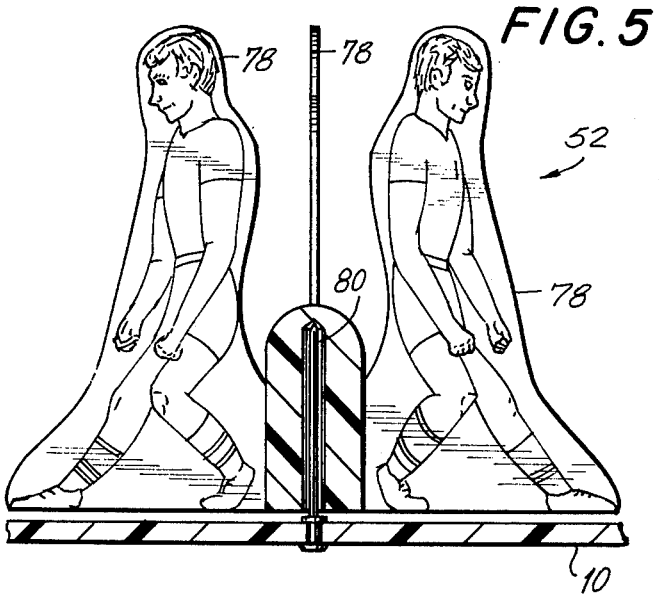
FIG. 5 is an enlarged sectional view taken substantially along the line 5—5 of FIG. 1.

FIG. 5 shows a typical baffle cluster 52 in enlarged view. The cluster 52 is of cruciform horizontal cross-section near its base and is provided with four thin flat individual vertical baffles 78 extending radially from a hub and each having a two-dimensional figure of a soccer player provided thereon, to complete the simulation of a soccer game. The hub has a blind central bore with an upper closed end. A central vertical spindle 80 with an upper pointed end is located in the bore, the hub resting on the pointed end so that the cluster is free to rotate about a central vertical axis under the influence of air streams such as 64, emanating from air guns such as 20, as described supra.

Figure 7:
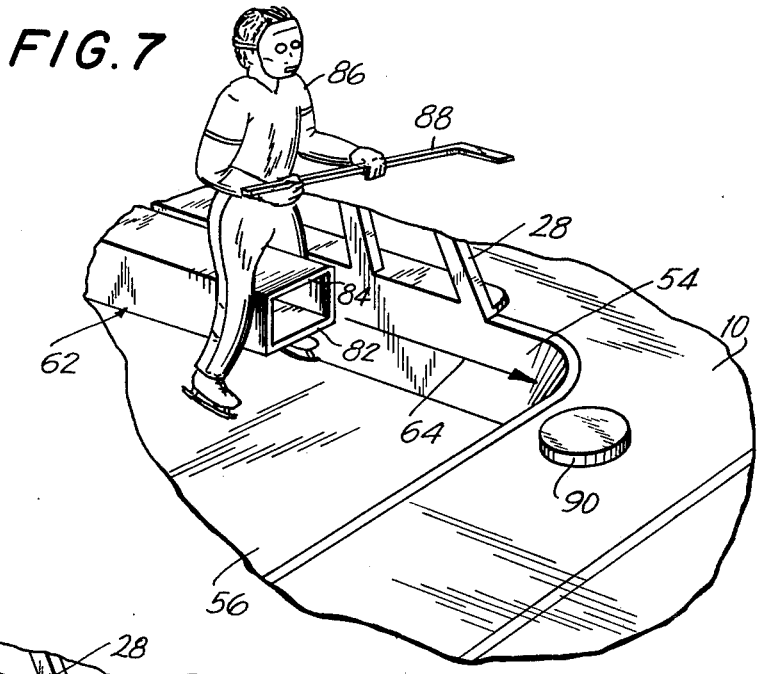
FIG. 7 is a view similar to FIG. 2 but in which the sport of ice hockey is simulated.

FIG. 7 illustrates an alternative embodiment of the invention, in which the game simulated is ice hockey and the air discharge tube 62 is of rectangular cross-section with the bottom wall 82 and the top wall 84 being longer than the side walls. A figurine 86 comparable to the goalie of a hockey team, complete with a miniature hockey stick 88, straddles the outlet end of the tube 62. To complete the analogy to a hockey game, a game piece 90 is provided in the form of a circular hockey puck.

Figure 8:
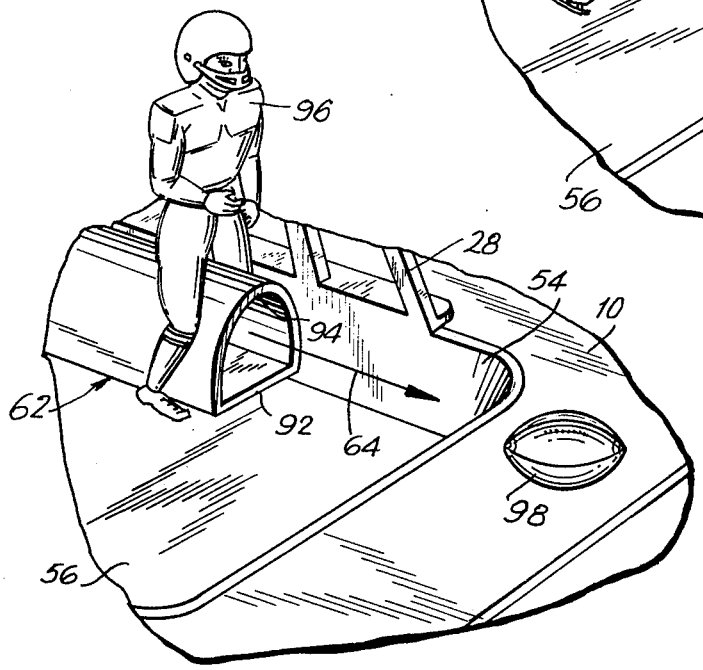
FIG. 8 is a view similar to FIG. 2 but in which the sport of football is simulated.

FIG. 8 illustrates another alternative embodiment of the invention, in which the game simulated is football and the air discharge tube 62 is of another alternative configuration, namely having a flat horizontal base or bottom 92 surmounted by a semicircular top section 94. A figurine 96 comparable to a football player straddles the outlet end of the tube 62. The game piece 98 in this case is in the form of a football.

Numerous alternatives within the scope of the present invention will occur to those skilled in the art. The table top 10 may be of other suitable configurations, e.g., round, square or elliptical, rather than rectangular. In some instances, additional goal areas besides the two goal areas 16 and 18 may be provided and disposed, e.g., at the middles of the sides of the table top. More than one game piece may be provided on the table top at a time and for a single game. Naturally if more than two goal areas are provided, and especially if also more than one game piece is provided for play, the number of players would be proportionately greater.

It thus will be seen that there are provided air action games which achieve the various objects of the invention and which are well adapted to meet the conditions of practical use.

As various possible embodiments might be made of the above invention, and as various changes might be made in the embodiments above set forth, it is to be understood that all matter herein described or shown in the accompanying drawings is to be interpreted as illustrative and not in a limiting sense.

Having thus described the invention, there is claimed as new and desired to be secured by Letters Patent:

1. An air action game comprising a table, said table having a flat horizontal top and peripheral side walls, said side walls extending above the level of the table top, said table top being provided with opposed recesses adjacent the central portions of at least two opposed side walls, means to project air in a substantially horizontal stream from above each recess and across the upper surface of the table top, means to mount each air projecting means for rotation about an associated vertical axis, a plurality of clusters of vertical air stream rotated baffles disposed on the upper surface of said table top, means mounting each cluster for free rotation about an associated vertical axis when contacted by an air stream, and a low density game piece, said game piece being disposed on said table top whereby the projected air streams move said game piece about on said table top under the control of opposing players manipulating the directions of said streams, said game piece being from time to time blocked and trapped by a cluster and thereafter flung along the table top by the trapping cluster when the cluster is freely rotated by an air stream.

2. The air action game of claim 1, in which the number of recesses is two.

3. The air action game of claim 1 wherein the air projecting means has a discharge end of non-circular cross-section to induce substantially laminar air flow.

4. The air action game of claim 3, in which the discharge end of the air projecting means is trapezoidal, the wider side of said trapezoidal discharge end being horizontally disposed below the narrower side of said trapezoidal discharge end.

5. The air action game of claim 3, in which the discharge end of air projecting means is rectangular, the wider sides of said rectangular discharge end being horizontal.

6. The air action game of claim 3, in which the discharge end of the air projecting means has a flat horizontal bottom surmounted by a semi-circular top member.

7. The air action game of claim 1 which further includes a different hand manipulatable lever associated with each air projecting means, said lever being provided with a vertical extension at its free end.

8. The air action game of claim 1, in which each cluster of rotatable vertical baffles is disposed on said table top as an individual unit having a curciform horizontal cross-section, each individual unit being rotatably supported at the top end of a vertical spindle extending upwards from the table top.

9. The air action game of claim 1, in which the corners at juncture of the side walls are curved.

10. The air action game of claim 1, in which the central portion of each side wall other than those including a recess is provided with a substantially triangular baffle, the apex of said baffle pointing towards the center of said top.

11. The air action game of claim 10, in which the sides of said triangular baffle extending from said apex are concave.

* * * * *